US006520586B2

(12) United States Patent
Park

(10) Patent No.: US 6,520,586 B2
(45) Date of Patent: Feb. 18, 2003

(54) SEATING STRUCTURE EQUIPPED WITH RETRACTABLE ARMREST

(76) Inventor: In Hyuk Park, 275 Tomhunter Rd., Fort Lee, NJ (US) 07024

( * ) Notice: Subject to any disclaimer, the term of this patent is extended or adjusted under 35 U.S.C. 154(b) by 63 days.

(21) Appl. No.: 09/862,537

(22) Filed: May 22, 2001

(65) Prior Publication Data

US 2002/0175550 A1 Nov. 28, 2002

(51) Int. Cl.[7] ..... A47C 7/54

(52) U.S. Cl. ..... 297/411.32; 297/144; 297/162; 297/411.45; 297/188.11; 297/173

(58) Field of Search ..... 297/411.32, 411.3, 297/411.2, 144, 145, 162, 248, 188.11, 411.45, 173

(56) References Cited

U.S. PATENT DOCUMENTS

| | | | | |
|---|---|---|---|---|
| 1,399,744 | A | | 12/1921 | Brophy |
| 2,409,316 | A | | 10/1946 | Rogers, Sr. |
| 2,466,204 | A | | 4/1949 | Brown |
| 3,467,432 | A | * | 9/1969 | Sullivan |
| 4,074,919 | A | | 2/1978 | Watts |
| 4,305,616 | A | | 12/1981 | Martinez |
| 4,938,534 | A | | 7/1990 | Tornero |
| 5,106,159 | A | | 4/1992 | Iwamoto |
| 5,423,596 | A | | 6/1995 | Laughlin et al. |
| D374,123 | S | | 10/1996 | Natuzzi et al. |
| 5,564,779 | A | * | 10/1996 | Tolbert et al. |
| 5,584,534 | A | * | 12/1996 | Kuranami |
| 5,927,779 | A | * | 7/1999 | Tornero |
| D425,319 | S | | 5/2000 | Kemnitzer |
| 6,237,997 | B1 | * | 5/2001 | Olson |
| 6,375,259 | B1 | * | 4/2002 | Ma |

FOREIGN PATENT DOCUMENTS

| | | |
|---|---|---|
| EP | 0133065 | 2/1985 |
| FR | 2460647 | 1/1981 |

* cited by examiner

*Primary Examiner*—Laurie K. Cranmer
(74) *Attorney, Agent, or Firm*—Selitto, Behr & Kim

(57) ABSTRACT

A seating structure includes a seat cooperating to define a space below the seat and at least one supporting member for supporting the seat. An armrest is movably mounted to the supporting member such that the armrest is movable between a first position, in which the armrest is positioned on a lateral side of the seat in an upright manner, and a second position, in which the armrest is positioned in the space such that it does not extend outwardly from the space. The armrest is movable to the second position for allowing the seating structure to be arranged with an identical seating structure in a side-by-side manner so as to form an array of seating structures.

20 Claims, 9 Drawing Sheets

SEATING STRUCTURE EQUIPPED WITH RETRACTABLE ARMREST

FIELD OF THE INVENTION

The present invention relates to seating structures and, more particularly, a seating structure having a retractable armrest. As used herein, the term "seating structure" shall mean any type of furniture used as a seat, including chairs, couches, benches and sofas.

BACKGROUND OF THE INVENTION

In the past, chairs or seats having folding or collapsible armrests have been known. For instance, U.S. Pat. Nos. 1,399,744, 2,409,316 and 4,938,534 and European Patent Publication No. 0 133 065 disclose chairs/seats equipped with armrests that are collapsible or retractable. However, these chairs/seats are not adapted for forming an array of chairs/seats.

French Patent Publication No. 2 460 647 discloses a folding theater seat equipped with a movable armrest. While the armrest can be positioned in a storage box, the seat is pre-formed as part of an array of seats and is hence difficult to use same as a single, "stand-alone" seat.

U.S. Pat. Nos. 2,466,204, 4,074,919, 4,305,616 and 5,106,159 relate to seats/chairs having removable armrests. While at least some of these seats/chairs are adapted to be arranged with other seats/chairs, the armrests need to be removed from the seats/chairs prior to forming an array of seats/chairs. As a result, forming an array of seats/chairs with the devices disclosed in these patents is difficult and/or inefficient.

SUMMARY OF THE INVENTION

The present invention overcomes the disadvantages and shortcomings of the prior art discussed above by providing a new and improved seating structure. More particularly, the seating structure includes a seat cooperating to define a space below the seat and at least one supporting member for supporting the seat. An armrest is movably mounted to the supporting member such that the armrest is movable between a first position, in which the armrest is positioned on a lateral side of the seat in an upright manner, and a second position, in which the armrest is positioned in the space such that it does not extend outwardly from the space. The armrest is movable to the second position for allowing the seating structure to be arranged with an identical seating structure in a side-by-side manner so as to form an array of seating structures.

BRIEF DESCRIPTION OF THE DRAWINGS

For a more complete understanding of the present invention, reference is made to the following detailed description of an exemplary embodiment considered in conjunction with the accompanying drawings, in which.

DETAILED DESCRIPTION OF THE INVENTION

Although the present invention can be used in conjunction with any type of seating structures, it is particularly suitable for use in connection with a couch. Accordingly, the present invention will be described hereinafter in connection with a couch. It should be understood, however, that the following description is only meant to be illustrative of the present invention and is not meant to limit the scope of the present invention, which has applicability to other types of seating structures, such as chairs, sofas and benches.

Figure 1:
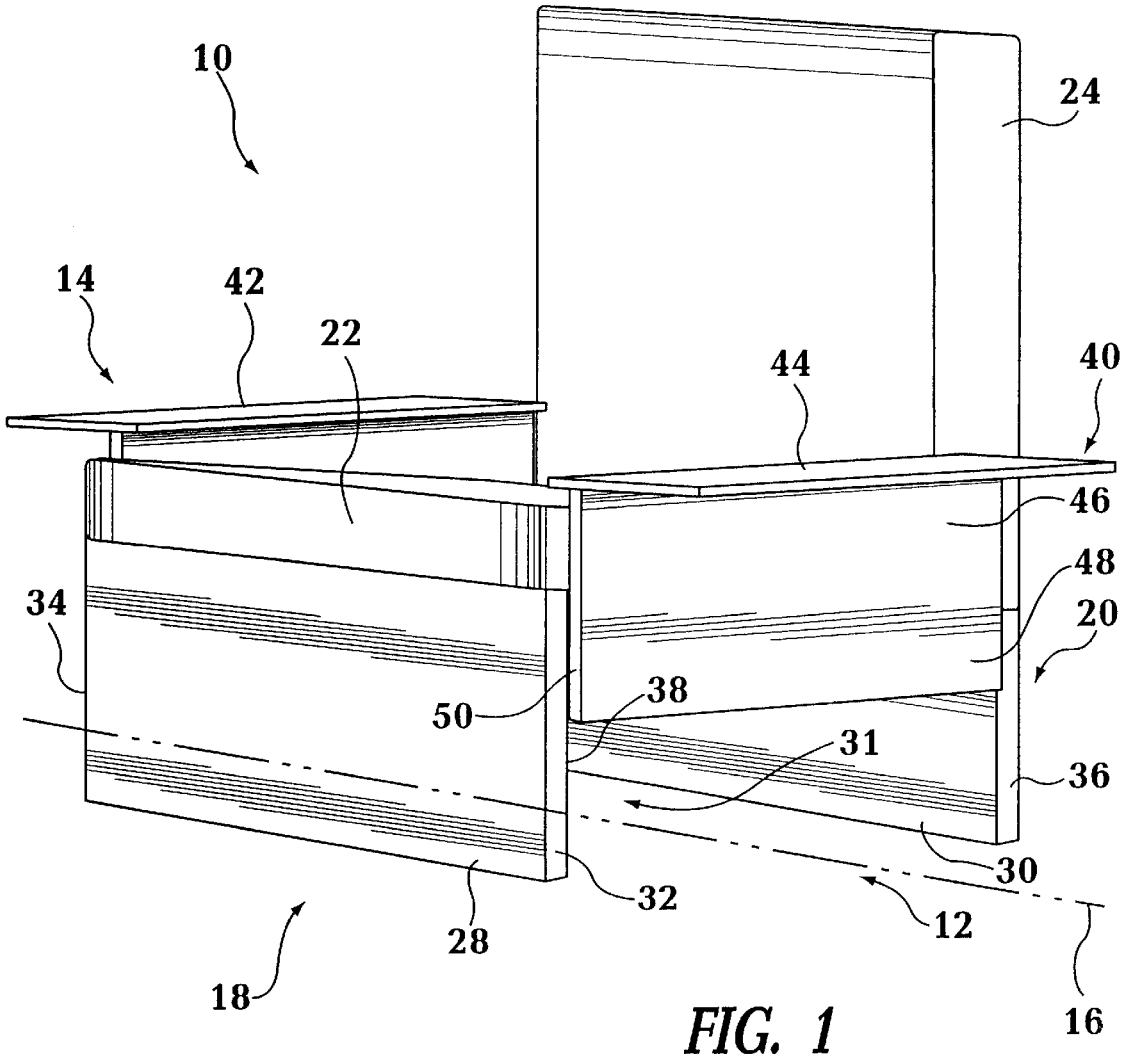
FIG. 1 is a perspective view of a seating structure constructed in accordance with the present invention and having an armrest assembly positioned in its upright position.
Figure 2:
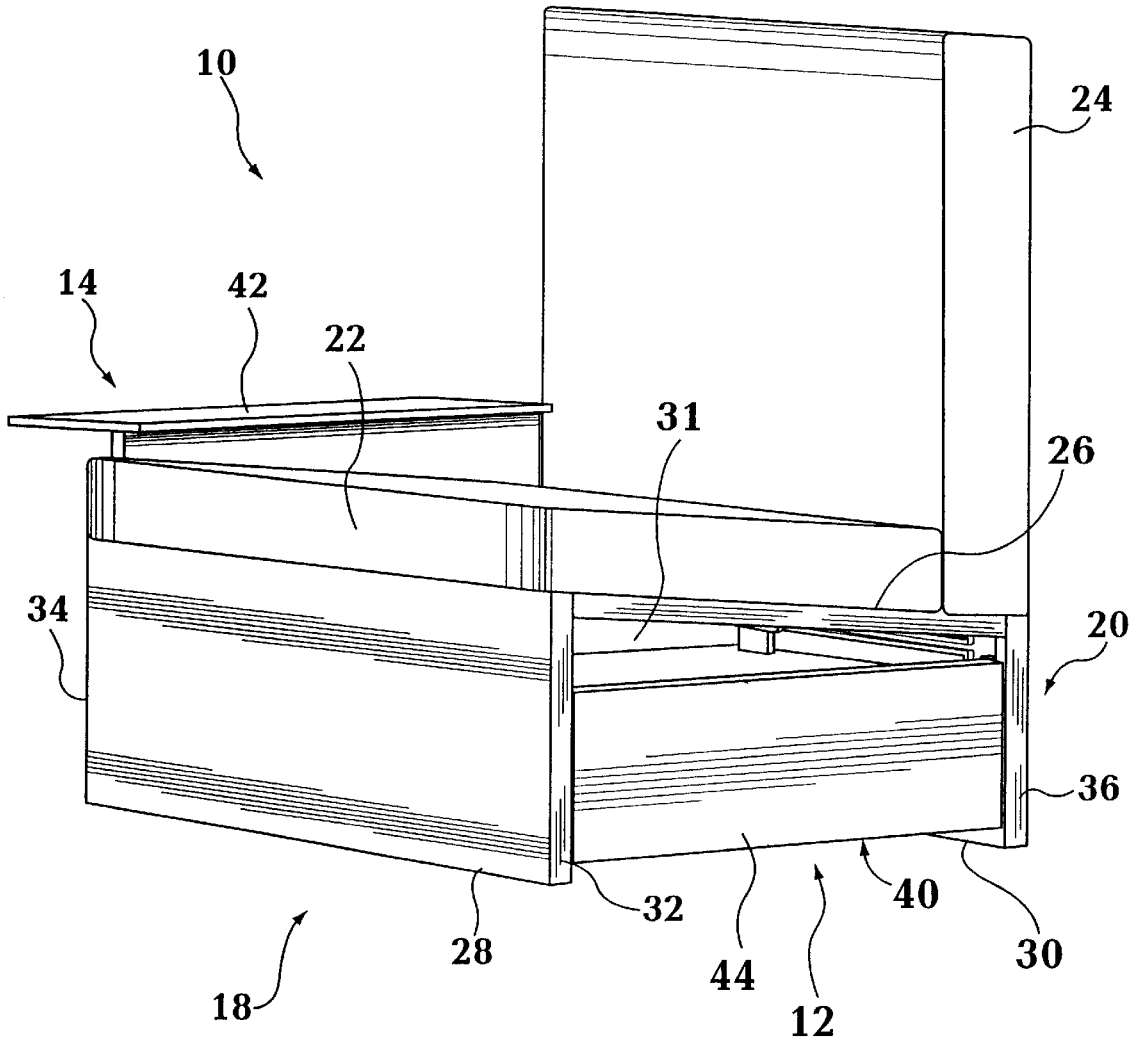
FIG. 2 is a view similar to FIG. 1, except that the armrest assembly is positioned in its retracted position.

FIGS. 1 and 2 show a couch 10 constructed in accordance with the present invention. The couch 10 has lateral sides 12, 14 opposed along a direction generally parallel to a longitudinal axis 16 of the couch 10 (referred to hereinafter as "the lateral direction"). The couch 10 also has front and rear sides 18, 20 opposed along a direction generally transverse to the longitudinal axis 16 (referred to hereinafter as "the transverse direction") The couch 10 is provided with a seat 22, which is oriented in a generally horizontal manner, and a backrest 24, which extends generally upwardly from the seat 22. A seat support 26 (see FIG. 2) is located below the seat 22 for supporting the seat 22. Front and rear support panels 28, 30 project downwardly from the seat support 26 for supporting the seat 22, as well as the couch 10. The front and rear support panels 28, 30, which extend generally along the front and rear sides 18, 20, respectively, of the couch 10, are spaced from each other so as to form a generally unobstructed space 31 (see FIG. 1) below the seat 22. The front and rear support panels 28, 30 have laterally opposing ends 32, 34 and laterally opposing ends 36, 38, respectively.

Figure 5:
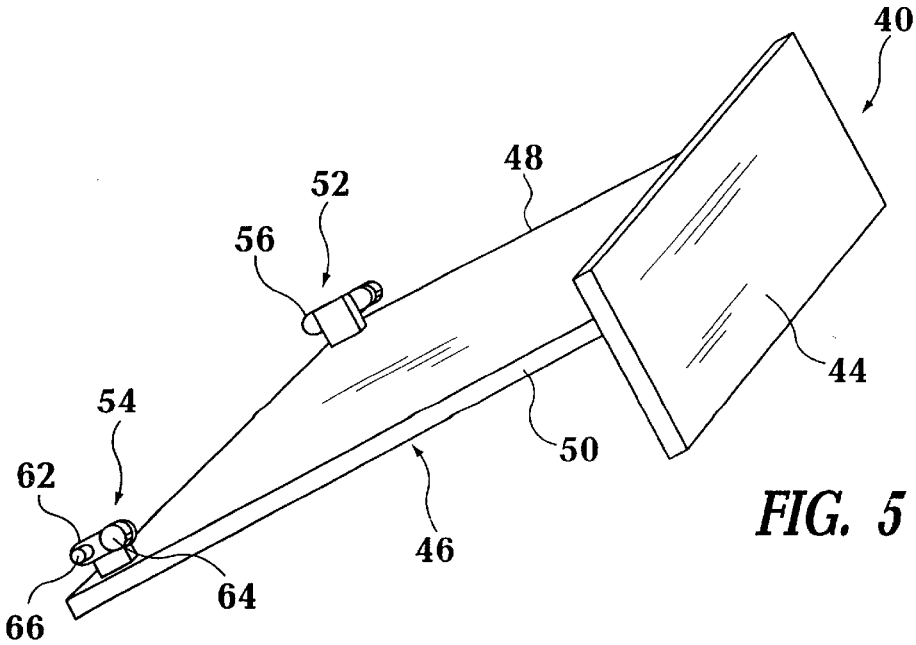
FIG. 5 is a perspective view of an armrest assembly of the seating structure shown in FIGS. 1–3.

Referring to FIGS. 1, 2 and 5, the couch 10 also includes a pair of armrest assemblies 40, 42. More particularly, the armrest assemblies 40, 42 are movable between their upright positions, in which they are positioned on the lateral sides 12, 14, respectively, of the couch 10 in an upright orientation (see FIG. 1), and their retracted positions, in which they are positioned in (i.e., retracted into) the space 31 below the seat 22 (see FIG. 2). The armrest assemblies 40, 42 have a construction and operation basically identical to one another. In such circumstances, the construction and operation of only one of the armrest assemblies 40, 42 (i.e., the armrest assembly 40) will be discussed hereinafter.

Figure 6:
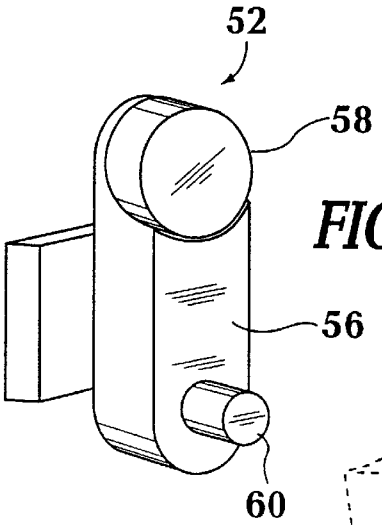
FIG. 6 is a perspective view of a wheel subassembly used in the armrest assembly shown in FIG. 5.

With reference to FIGS. 1, 2 and 5, the armrest assembly 40 is provided with an armrest 44 and a support member 46 depending from the armrest 44. The support member 46 has opposing ends 48, 50 and is provided with a pair of wheel subassemblies 52, 54 affixed to the support member 46 at the ends 48, 50, respectively. Referring to FIGS. 5 and 6, the wheel subassembly 52 includes a connecting frame 56 affixed to the support member 46 and having an elongated shape. Inner and outer wheels 58, 60 are rotatably mounted to the connecting frame 56 at opposite ends thereof. More particularly, the inner and outer wheels 58, 60 are mounted to the connecting frame 56 such that they are spaced from one another along a direction generally parallel to the support member 46. The outer wheel 60 also projects from the connecting frame 56 outwardly in the transverse direction such that the outer wheel 60 is offset relative to the inner wheel 58 in that direction. The outer wheel 60 has a size smaller than the inner wheel 58.

Now referring to FIG. 5, the wheel subassembly 54 has a construction identical to that of the wheel subassembly 52. For instance, the wheel subassembly 54 includes a connecting frame 62 affixed to the support member 46 and having an elongated shape. Inner and outer wheels 64, 66 are rotatably mounted to the connecting frame 62 at opposite ends thereof. More particularly, the inner and outer wheels 64, 66 are mounted to the connecting frame 62 such that they are spaced from one another along a direction generally parallel to the support member 46. The outer wheel 66 also projects from the connecting frame 62 outwardly in the transverse direction such that the outer wheel 66 is offset relative to the inner wheel 64 in that direction. The outer wheel 66 has a size smaller than the inner wheel 64.

Figure 3:
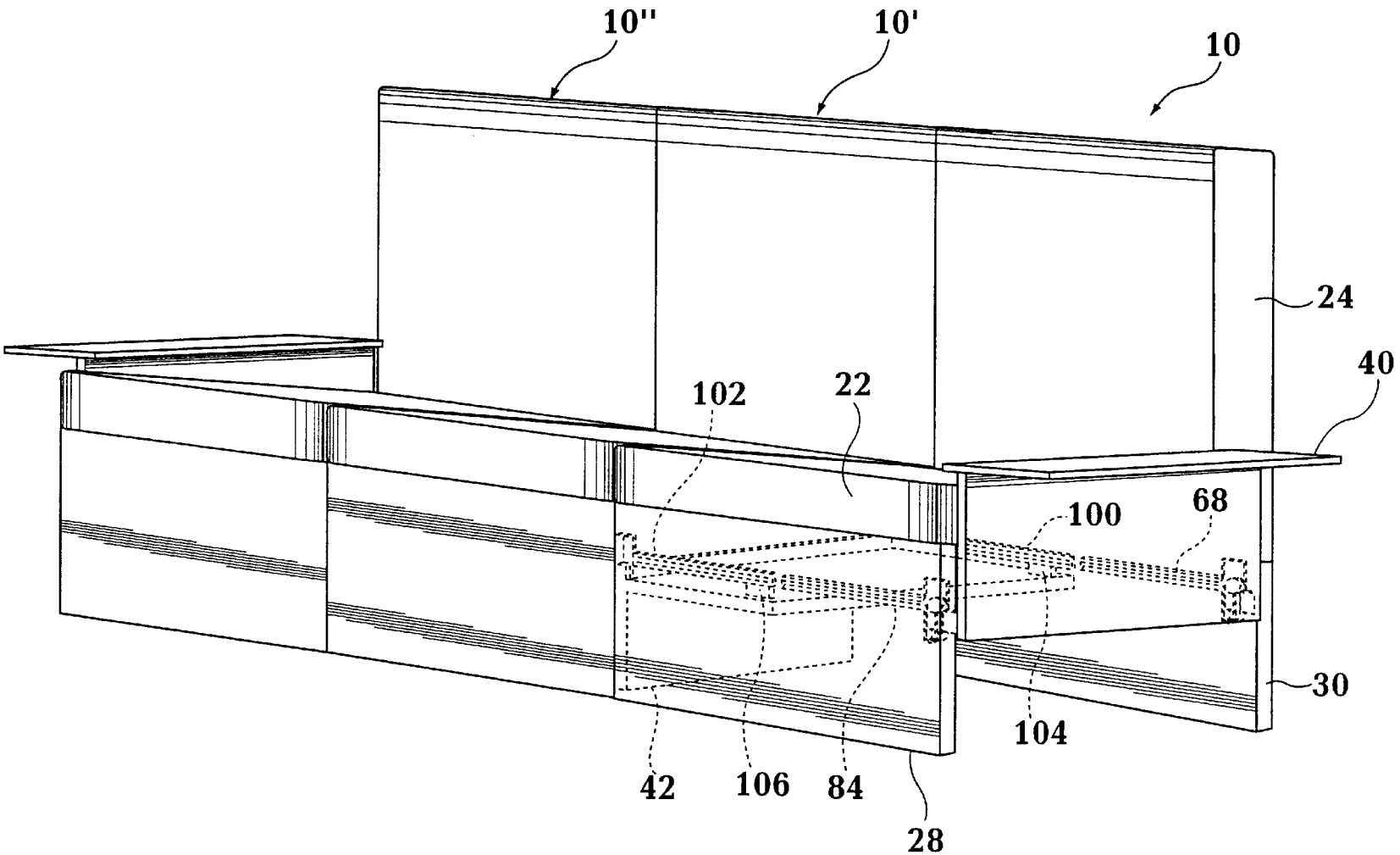
FIG. 3 is a perspective view of the seating structure shown in FIGS. 1 and 2 and arranged with other seating structures so as to form a linear array of seats.
Figure 4:
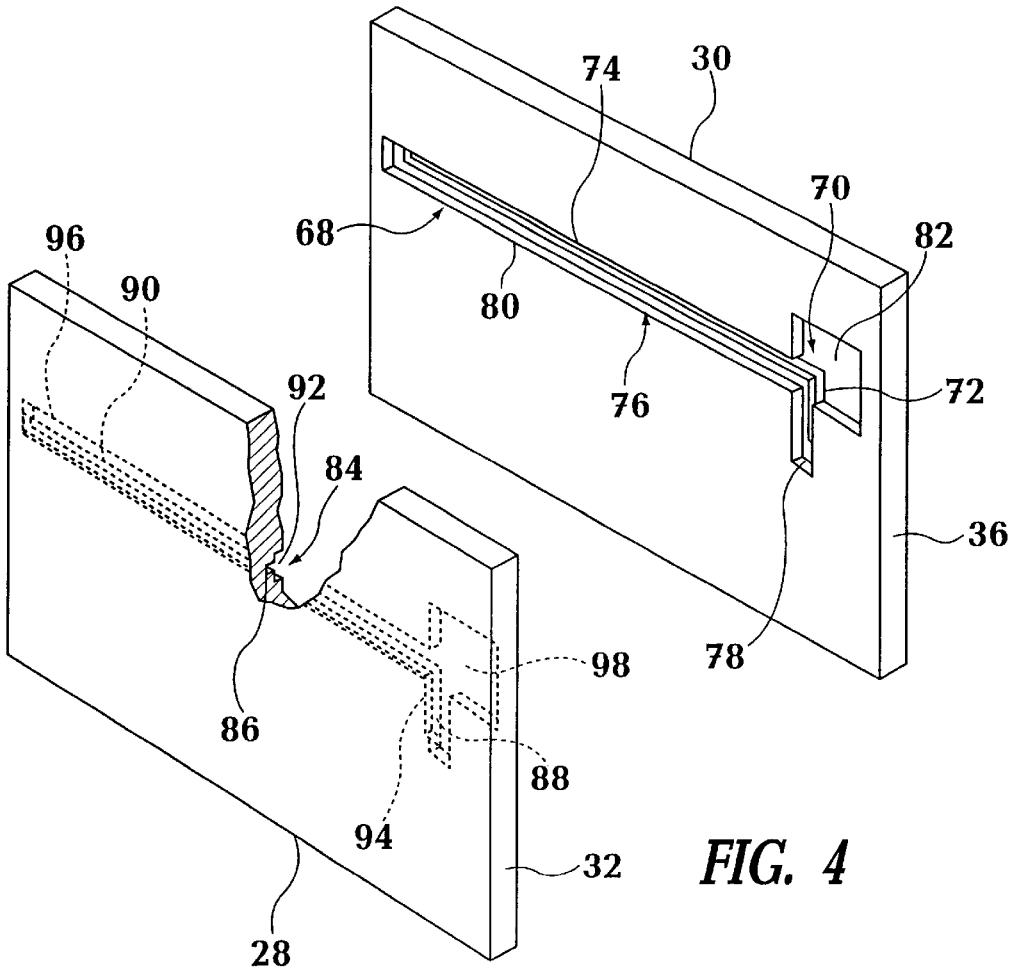
FIG. 4 is a perspective view of front and rear support panels of the seating structure shown in FIGS. 1–3.

With reference to FIGS. 3 and 4, a track 68 is formed in the rear support panel 30 and extends in the lateral direction. The track 68 includes an outer track 70 sized and shaped so as to receive the outer wheel 60 of the armrest assembly 40 such that the outer wheel 60 is movable along the outer track 70. The outer track 70 is equipped with a vertical section 72, which is located adjacent the end 36 of the rear support panel 30 and which extend in a vertical direction, and a horizontal section 74, which extends in a horizontal direction from the vertical section 72. The horizontal section 74 and the vertical section 72 are connected such that they form a single, continuous track.

Figure 8:
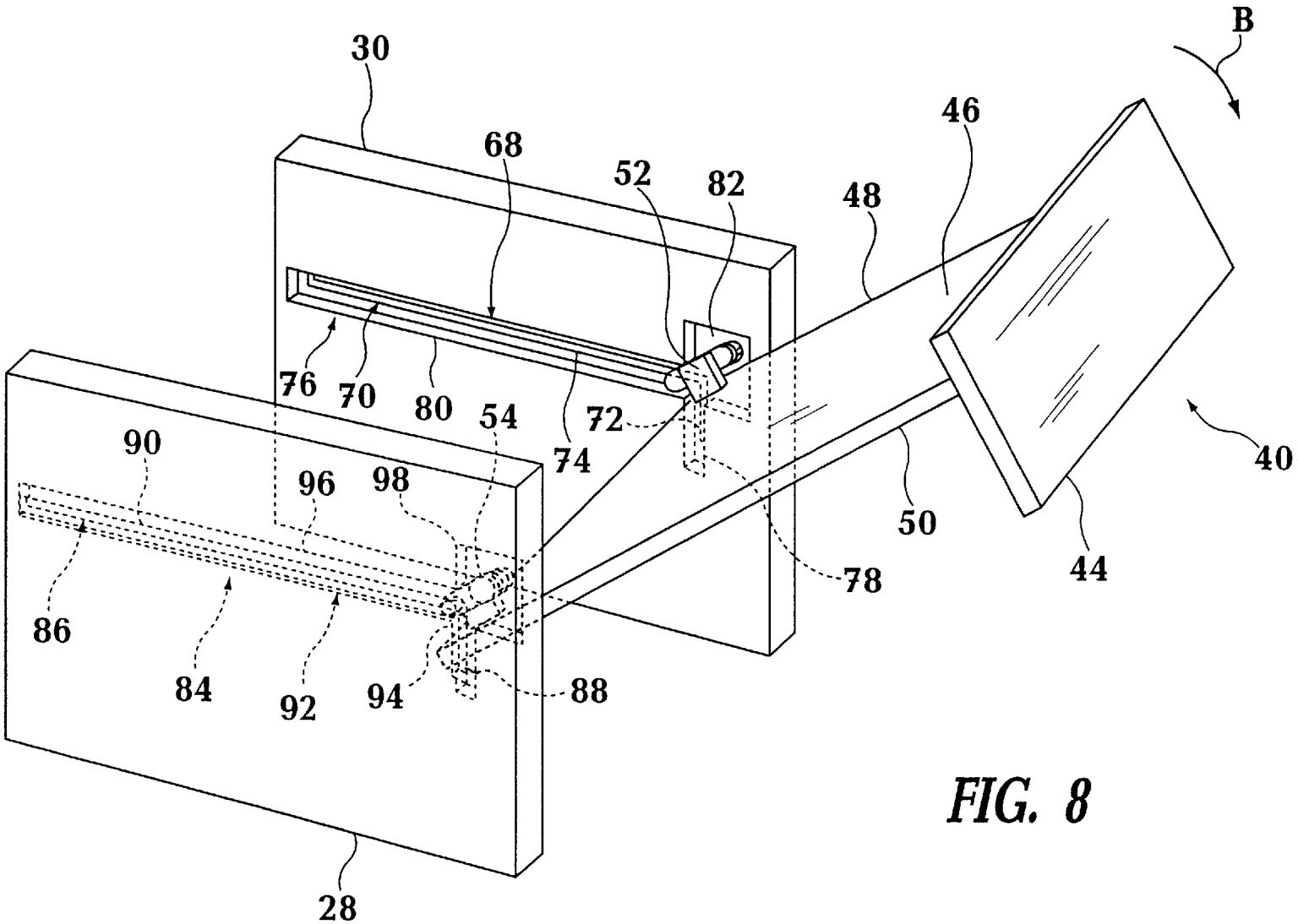
Figure 9:
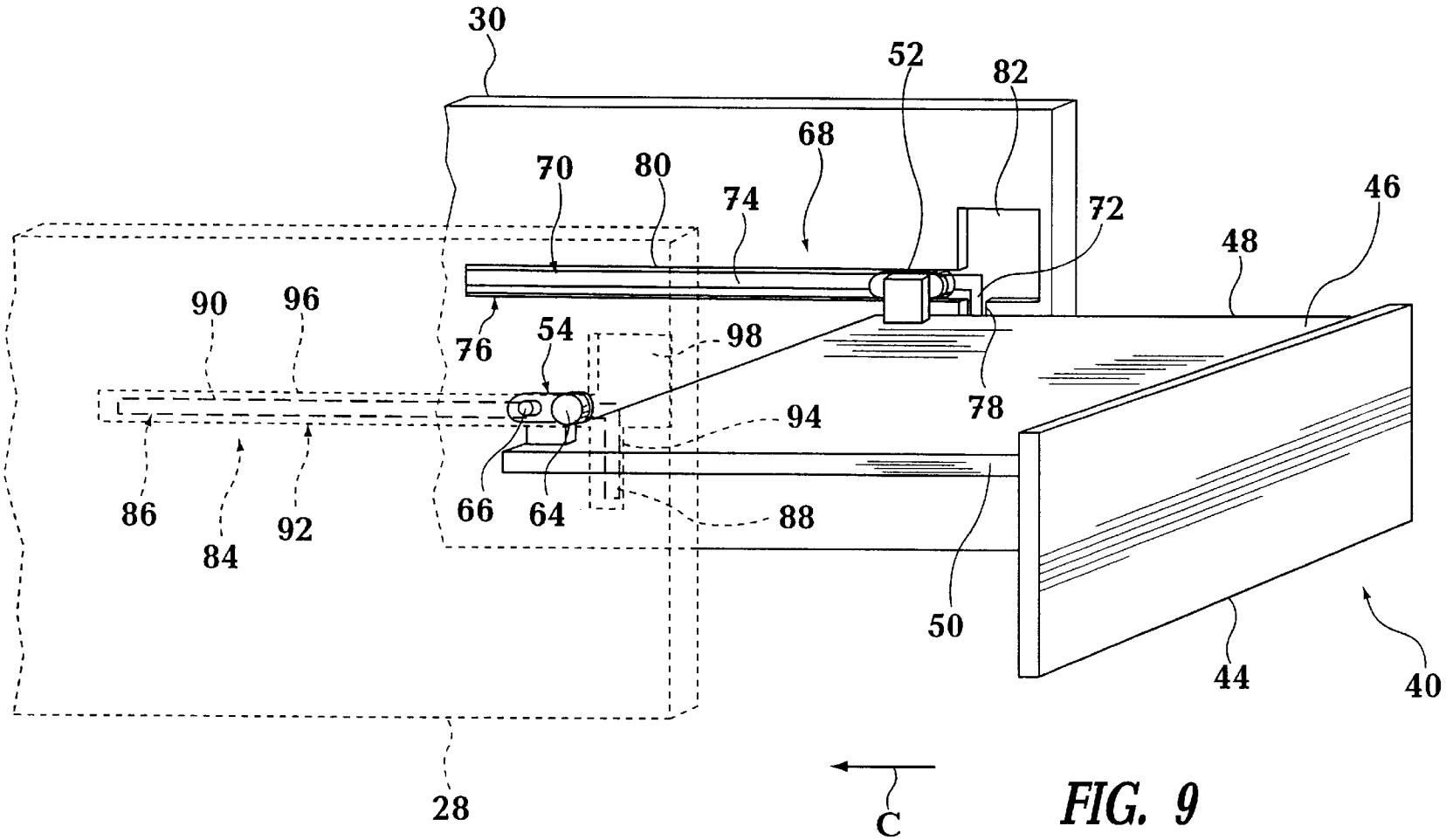
Figure 12:
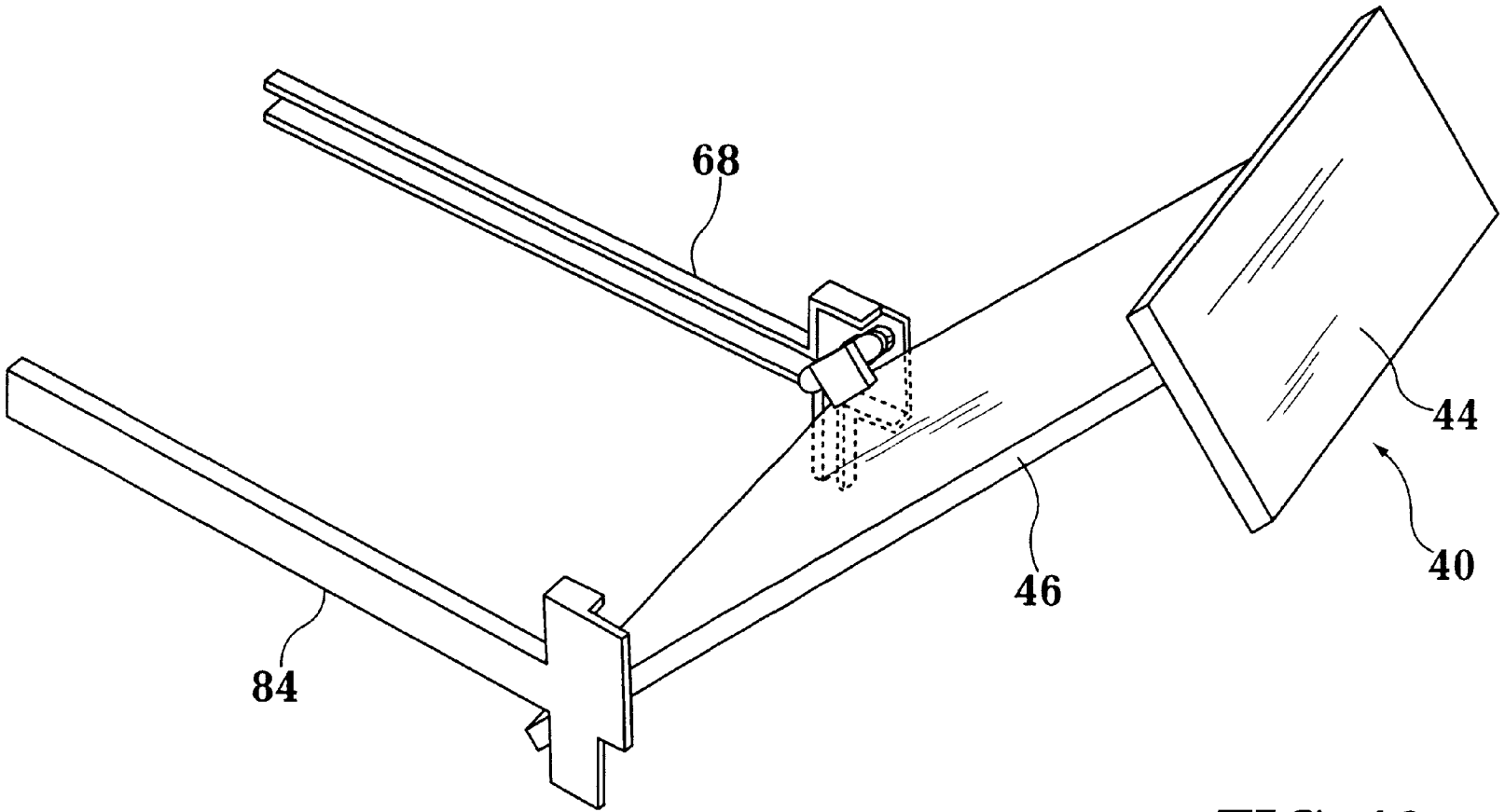
FIG. 12 is a schematic view illustrating a modified version of tracks of the seating structure shown in FIGS. 1–3.

Still referring to FIGS. 3 and 4, the track 68 also includes an inner track 76 positioned inwardly in the transverse direction relative to the outer track 70. That is, the inner track 76 is offset inwardly relative to the outer track 70 in the transverse direction. The inner track 76 is sized and shaped so as to receive the inner wheel 58 of the armrest assembly 40 such that the inner wheel 58 is movable along the inner track 76. Like the outer track 70, the inner track 76 includes a vertical section 78, which is located adjacent the end 36 of the rear support panel 30 and which extend in a vertical direction, and a horizontal section 80, which extends in a horizontal direction from the vertical section 78. The vertical and horizontal sections 78, 80 of the inner track 76 are positioned such that they are aligned with the vertical and horizontal sections 72, 74, respectively, of the outer track 70. The inner track 76 also includes a pivot section 82 located adjacent the end 36 of the rear support panel 30. The pivot section 82 interconnects the vertical section 78 to the horizontal section 80. The pivot section 82 is sized and shaped such that the wheel subassembly 52 is pivotable therewithin (see FIG. 8) so as to permit the inner and outer wheels 58, 60 to be transported from the horizontal sections 80, 74, respectively, of the inner and outer tracks 76, 70, respectively, to the vertical sections 78, 72, respectively, of the inner and outer tracks 76, 70, respectively, and vice versa.

A track 84 is also formed in the front support panel 28 and extends in the lateral direction (see FIGS. 3, 4 and 8–10). The track 84 includes an outer track 86 sized and shaped so as to receive the outer wheel 66 of the armrest assembly 40 such that the outer wheel 66 is movable along the outer track 86. The outer track 86 is equipped with a vertical section 88, which is located adjacent the end 32 of the front support panel 28 and which extend in a vertical direction, and a horizontal section 90, which extends in a horizontal direction from the vertical section 88. The horizontal section 90 and the vertical section 88 are connected such that they form a single, continuous track.

With reference to FIGS. 3, 4 and 8–10, the track 84 also includes an inner track 92 positioned inwardly in the transverse direction relative to the outer track 86. That is, the inner track 92 is offset inwardly relative to the outer track 86 in the transverse direction. The inner track 92 is sized and shaped so as to receive the inner wheel 64 of the armrest assembly 40 such that the inner wheel 64 is movable along the inner track 92. Like the outer track 86, the inner track 92 includes a vertical section 94, which is located adjacent the end 32 of the front support panel 28 and which extend in a vertical direction, and a horizontal section 96, which extends in a horizontal direction from the vertical section 94. The vertical and horizontal sections 94, 96 of the inner track 92 are positioned such that they are aligned with the vertical and horizontal sections 88, 90, respectively, of the outer track 86. The inner track 92 also includes a pivot section 98 located adjacent the end 32 of the front support panel 28. The pivot section 98 interconnects the vertical section 94 to the horizontal section 96. The pivot section 98 is sized and shaped such that the wheel subassembly 54 is pivotable therewithin (see FIG. 8) so as to permit the inner and outer wheels 64, 66 to be transported from the horizontal sections 96, 90, respectively, of the inner and outer tracks 92, 86, respectively, to the vertical sections 94, 88, respectively, of the inner and outer tracks 92, 86, respectively, and vice versa.

Now referring to FIG. 3, the rear and front support panels 30, 28 also include separate tracks 100, 102, respectively, formed therein for permitting movement of the armrest assembly 42 between its upright position and its retracted position. The tracks 100, 102 have a construction basically identical to that of the tracks 68, 84 for engagement with wheel subassemblies 104, 106 of the armrest assembly 42. While the tracks 100, 102 are formed as separate tracks, they can be formed as a single, continuous track with the tracks 68, 84, respectively.

Figure 10:
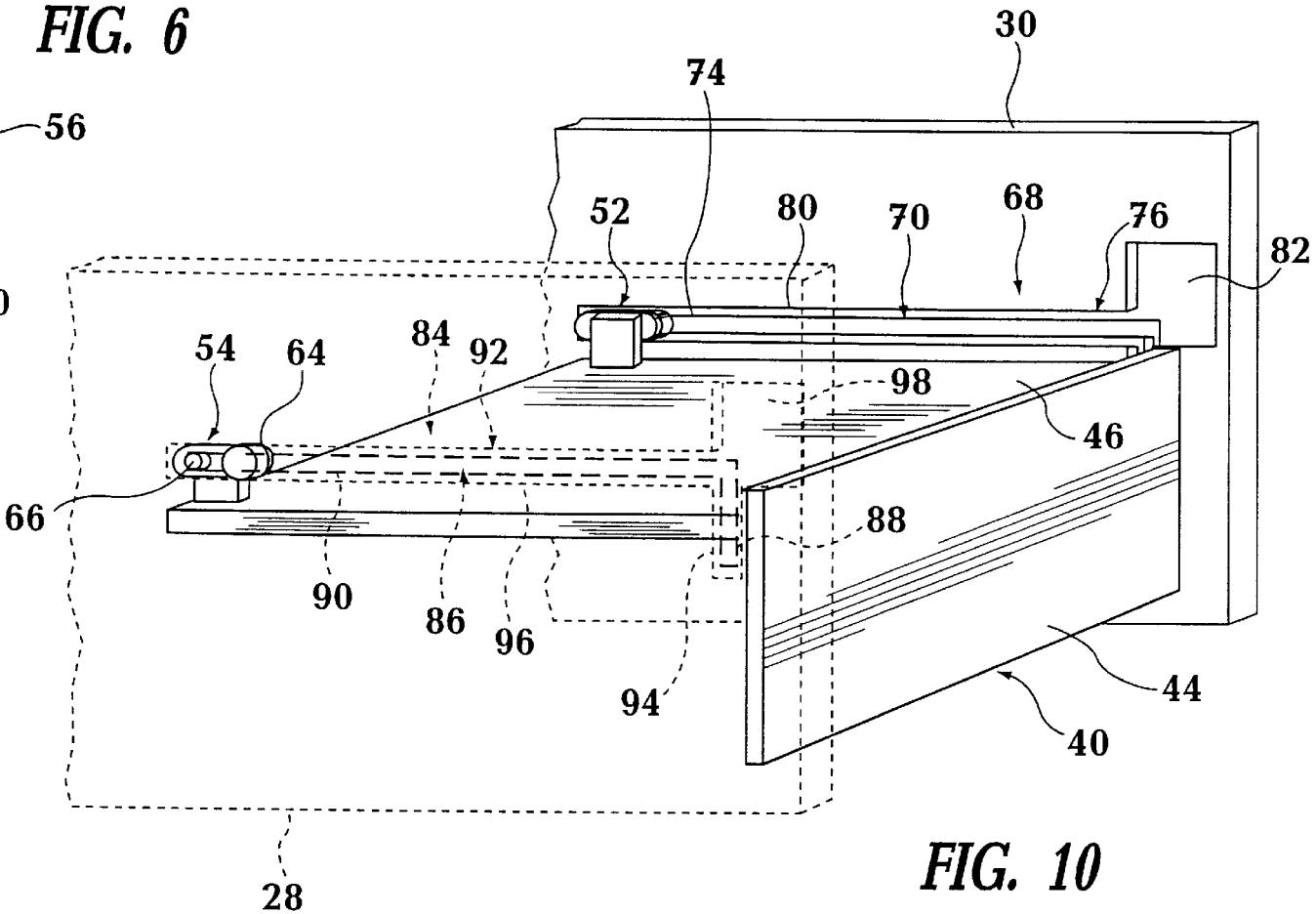
FIGS. 7–10 are schematic views of the armrest assembly shown in FIG. 5 as it is moved from its upright position to its retracted position and vice versa.

Referring to FIGS. 7–10, the tracks 68, 84 and the wheel subassemblies 52, 54, respectively, cooperate so as to permit the armrest assembly 40 to move between its upright position (see FIGS. 1 and 7) and its retracted position (see FIGS. 2 and 10). More particularly, in its upright position, the armrest assembly 40 is located on the lateral side 12 of the couch in an upright manner such that it is adapted to support an arm of a person sitting on the couch 10. In this position, the inner and outer wheels 58, 60 of the wheel subassembly 52 are positioned in the vertical sections 78, 72, respectively, of the inner and outer tracks 76, 70, respectively (see FIG. 7), while the inner and outer wheels 64, 66 of the wheel subassembly 54 are positioned in the vertical sections 94, 88, respectively, of the inner and outer tracks 92, 86, respectively. In this manner, the armrest assembly 40 is securely maintained in its upright position.

In order to move the armrest assembly 40 from its upright position to its retracted position, the armrest assembly 40 is lifted upwardly relative to the couch 10 (as indicated by arrow A in FIG. 7), releasing the inner and outer wheels 58, 60 from the vertical sections 78, 72, respectively, of the inner and outer tracks 76, 70, respectively, and the inner and outer wheels 64, 66 from the vertical sections 94, 88, respectively, of the inner and outer tracks 92, 86, respectively. When the wheel subassemblies 52, 54 are positioned in the pivot sections 82, 98, respectively, of the tracks 68, 84, respectively, the armrest assembly 40 is pivoted downwardly (as indicated by arrow B shown in FIG. 8) until it is oriented horizontally. The armrest assembly 40 is then pushed in the lateral direction toward the lateral side 14 of the couch 10 (as indicated by arrow C in FIG. 9), causing the inner and outer wheels 58, 60 to roll into the horizontal sections 80, 74, respectively, of the inner and outer tracks 76, 70, respectively, and causing the inner and outer wheels 64, 66 to roll into the horizontal sections 96, 90, respectively, of the inner and outer tracks 92, 86, respectively. The armrest assembly 40 is pushed in the lateral direction until the armrest assembly 40 is positioned completely within the space 31 (i.e., the armrest assembly 40 does not extend outwardly from the space 31), positioning the armrest assembly 40 in its retracted position (see FIGS. 2 and 10). The armrest assembly 40 is maintained in its retracted position by the engagement of the inner and outer wheels 58, 60 and the inner and outer wheels 64, 66 to the track 68 and the track 84, respectively.

As noted above, the armrest assembly 42 operates in a manner identical to that of the armrest assembly 40. For instance, like the armrest assembly 40, the armrest assembly 42 is movable between its upright position (see FIGS. 1 and 2) and its retracted position (see FIG. 3) in a manner identical to the one discussed above in connection with the armrest assembly 40.

It should be appreciated that the present invention provides numerous advantages over the prior art discussed above. For instance, because the armrest assemblies 40, 42 can be independently and selectively positioned in their retracted positions, in which they are stored completely within the space 31 (i.e., they do not extend outwardly from the space 31), the couch 10 is adapted to be clustered with identical or similar couches in a side-by-side manner so as to form an array of seats or seating structures (see FIG. 3). More particularly, in FIG. 3, the armrest assembly 42 is positioned in its retracted position, allowing the couch 10 to be adjoined to an identical couch 10' having its right-side armrest assembly (not shown) positioned in a retracted position. In this manner, the present invention is adapted to provide an infinitely varying number of seat arrangements. In other words, the couch 10 can be used as a single, "stand-alone" (i.e., independent) unit or as a sub-unit in an array of couches.

The tracks 68, 84 and wheel subassemblies 52, 54 of the couch 10 also provide additional advantages over the prior art discussed above. For instance, because of the tracks 68, 84 and wheel subassemblies 52, 54, the armrest assemblies 40, 42 can be positioned in their retracted positions in a simple and efficient manner without removing them from the couch 10.

Figure 11:
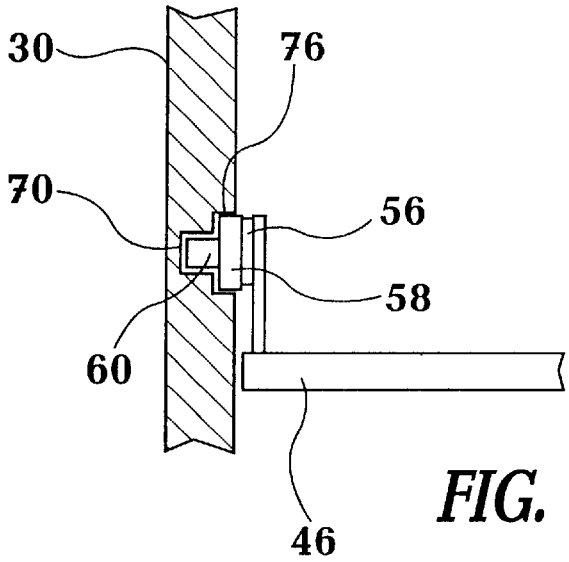
FIG. 11 is a schematic view of the wheel assembly shown in FIG. 6 in engagement with a track of the seating structure.
Figure 7:
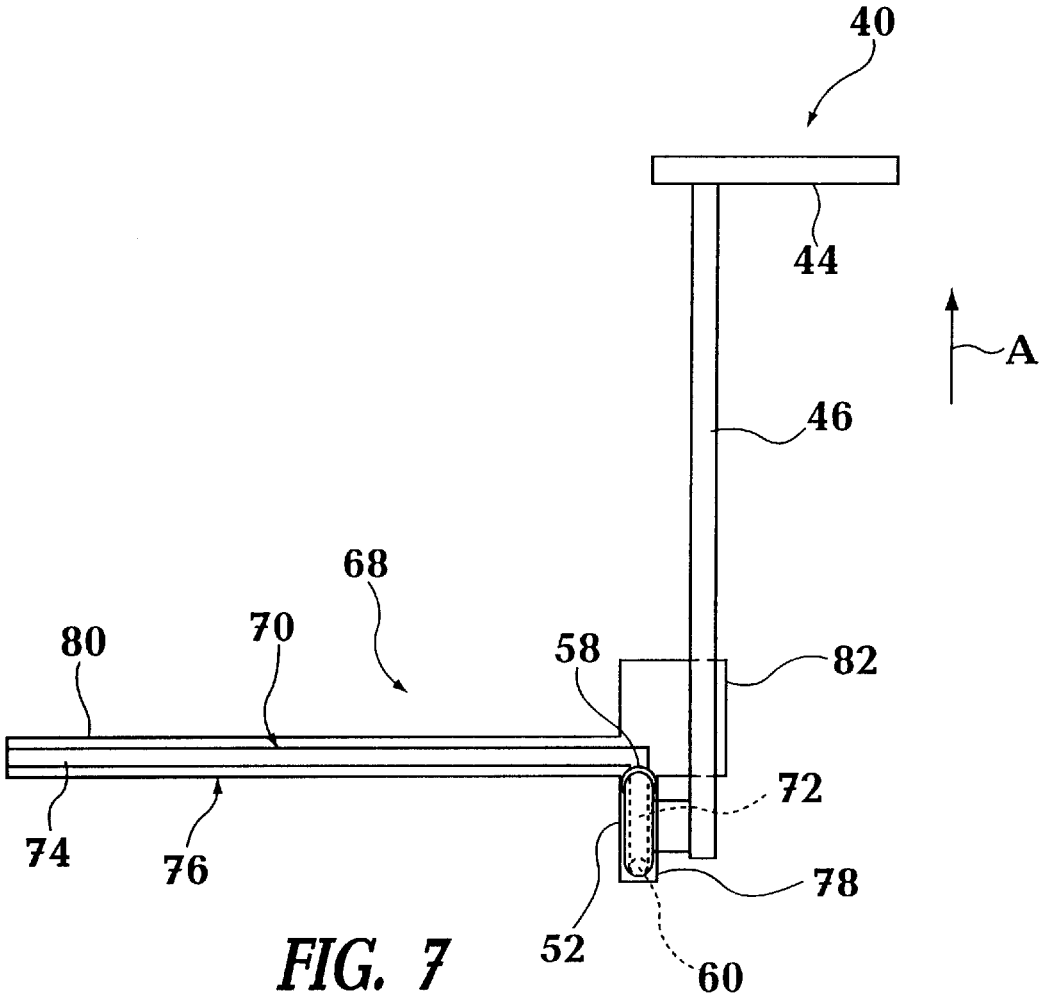

It should be noted that the present invention can have numerous modifications and variations. For instance, while the tracks 84, 102 and the tracks 68, 100 of the couch 10 shown in FIGS. 1–10 are integrally formed in the front and rear support panels 28, 30, respectively, they can be formed as discrete and independent members (see FIG. 11) removably or permanently attached to the front and rear support panels 28, 30, respectively. Moreover, different mechanisms can be used for the tracks 68, 84, 100, 102 and/or the wheels 58, 60, 64, 66 for permitting the armrest assemblies 40, 42 to be moved between their retracted positions and their upright positions. The front and rear support panels 28, 30 can also be replaced with other support members.

It will be understood that the embodiment described herein is merely exemplary and that a person skilled in the art may make many variations and modifications without departing from the spirit and scope of the invention. All such variations and modifications, including those discussed above, are intended to be included within the scope of the invention as defined in the appended claims.

I claim:

1. A seating structure comprising a seat cooperating to define a space below said seat; at least one supporting member for supporting said seat; and an armrest movably mounted to said at least one supporting member such that said armrest is movable between a first position, in which said armrest is positioned on a lateral side of said seat in an upright manner, and a second position, in which said armrest is positioned in said space such that it does not extend outwardly from said space, said armrest being movable to its said second position for allowing said seating structure to be arranged with an identical seating structure in a side-by-side manner so as to form an array of seating structures.

2. The seating structure of claim 1, further comprising moving means for permitting said armrest to move between its said first and second positions.

3. The seating structure of claim 2, wherein said moving means includes at least one track extending along a direction generally parallel to a longitudinal axis of said seating structure.

4. The seating structure of claim 3, wherein said moving means includes at least one wheel connected to said armrest, said at least one wheel being engageable with said at least one track.

5. The seating structure of claim 4, wherein said seat has first and second opposing sides extending generally parallel to said longitudinal axis; and wherein said at least one track includes a first track, which extends generally along said first side of said seat, and a second track, which extends generally along said second side of said seat.

6. The seating structure of claim 5, wherein said at least one wheel includes a first wheel engageable with said first track and a second wheel engageable with said second track.

7. The seating structure of claim 6, wherein said at least one track includes a third track, which extends along said first side of said seat, and a fourth track, which extends along said second side of said seat.

8. The seating structure of claim 7, wherein said at least one wheel includes a third wheel engageable with said third track and a fourth wheel engageable with said fourth track.

9. The seating structure of claim 8, wherein said at least one supporting member includes a first support panel, which is located adjacent said first side of said seat, and a second support panel, which is located adjacent said second side of said seat, said first and second support panels cooperating with said seat so as to define said space.

10. The seating structure of claim 9, wherein said armrest includes a supporting unit, said first and third wheels being mounted on one end of said supporting unit, and said second and fourth wheels being mounted on an opposite end of said supporting unit.

11. The seating structure of claim 10, wherein said first and third tracks are formed in said first support panel; and wherein said second and fourth tracks are formed in said second support panel.

12. The seating structure of claim 10, wherein said first and third tracks are mounted to said first support panel; and wherein said second and fourth tracks are mounted to in said second support panel.

13. The seating structure of claim 4, wherein said at least one track includes a vertical section, which extends in a vertical direction, and a horizontal section, which extends from said vertical section in a horizontal direction.

14. The seating structure of claim 13, wherein said at least one wheel is located in said vertical section when said armrest is positioned in its said first position; and wherein said at least one wheel is located in said horizontal section when said armrest is positioned in its said second position.

15. The seating structure of claim 14, wherein said seat has first and second opposing sides extending generally parallel to said longitudinal axis; and wherein said at least one track includes first and second tracks, which are located adjacent said first side of said seat, and third and fourth tracks, which are located adjacent said second side of said seat; and wherein said at least one wheel includes first and second wheels engageable with said first and second tracks, respectively, and third and fourth wheels engageable with said third and fourth tracks, respectively.

16. The seating structure of claim 15, wherein said at least one supporting member includes a first support panel, which is located adjacent said first side of said seat, and a second support panel, which is located on said second side of said seat, said first and second tracks being connected to said first support panel, and said third and fourth tracks being connected to said second support panel.

17. The seating structure of claim 16, wherein said first wheel has a size smaller than that of said second wheel; and wherein said third wheel has a size smaller than that of said fourth wheel.

18. The seating structure of claim 14, wherein said at least one track includes a pivot section connecting said vertical section to said horizontal section for permitting movement of said at least one wheel between said vertical and horizontal sections.

19. The seating structure of claim 1, further comprising a second armrest movably mounted to said at least one supporting member such that said second armrest is movable between a third position, in which said second armrest is positioned on an opposite lateral side of said seat in an upright manner, and a fourth position, in which said second armrest is positioned in said space such that it does not extend outwardly from said space, said second armrest being movable to its said fourth position for allowing said seating structure to be arranged with an identical seating structure in a side-by-side manner so as to form an array of seating structures.

20. The seating structure of claim 19, further comprising second moving means for permitting said second armrest to move between its said third and fourth positions.

* * * * *